US006550608B1

(12) United States Patent
Brown et al.

(10) Patent No.: US 6,550,608 B1
(45) Date of Patent: Apr. 22, 2003

(54) CARTON FEEDING SYSTEM FOR PACKAGING MACHINE

(75) Inventors: Steven D. Brown, Canton, GA (US); Colin Ford, Woodstock, GA (US)

(73) Assignee: Riverwood International Corporation, Atlanta, GA (US)

( * ) Notice: Subject to any disclaimer, the term of this patent is extended or adjusted under 35 U.S.C. 154(b) by 42 days.

(21) Appl. No.: 10/029,749

(22) Filed: Nov. 2, 2001

(51) Int. Cl.[7] ..... B65G 15/60
(52) U.S. Cl. ..... 198/837; 198/840; 198/841
(58) Field of Search ..... 198/837, 840, 198/841

(56) References Cited

U.S. PATENT DOCUMENTS 3,554,355 A * 1/1971 Berg ..... 198/36
3,640,377 A * 2/1972 Benoit ..... 198/178
3,810,537 A * 5/1974 Hungtington ..... 198/57
3,946,856 A * 3/1976 Herrera ..... 198/84
3,955,668 A * 5/1976 Buschbom et al. ..... 198/188
4,438,617 A * 3/1984 Ulrich et al. ..... 53/137
5,038,919 A * 8/1991 Harston ..... 198/626.1
5,346,050 A * 9/1994 Mojden et al. ..... 198/345.2
5,410,389 A * 4/1995 Poehlein ..... 355/212
5,562,201 A * 10/1996 Kennedy et al. ..... 198/841

* cited by examiner

*Primary Examiner*—Joseph E. Valenza
*Assistant Examiner*—Rashmi Sharma

(57) ABSTRACT

A carton feeding system for feeding cartons into a packaging machine is disclosed. The carton feeding system includes a frame in which a carton feeder is rotatably mounted and a carton guide assembly. The carton guide assembly includes a pair of spaced guide tracks along which guide chains are moved to engage and urge the cartons along the carton feeding system toward a drop point overlying a series of products passing therebeneath. A pair of spaced chute plates receive and support the ends of the cartons as the cartons are released by the carton feeder and are urged by the guide chains along a feed path toward the drop point and engagement with a series of products passing through the product-packaging machine.

27 Claims, 5 Drawing Sheets

CARTON FEEDING SYSTEM FOR PACKAGING MACHINE

FIELD OF THE INVENTION

The present invention generally relates to packaging machinery and systems for packaging articles in containers or cartons. In particular, the present invention relates to a carton feeding system for feeding cartons into a product-packaging machine for packaging selected series or groups of articles or products passing through the packaging machine.

BACKGROUND OF THE INVENTION

The packaging of goods such as packaging soft drink cans or bottles in cartons for formation of beverage "twelve-packs," "eight-packs," or other arrangements, has been performed as an automated operation in the packaging field for a number of years. Typically, in such an automated packaging operation, individual cartons generally are selected from a stack or magazine of cartons by a carton feeder for feeding each carton into the packaging machine where they are generally deposited onto a selected group after which the cartons are wrapped or engaged about a series of products such as a twelve-pack of soft drink bottles or cans. Given the positioning of conventional product selector mechanisms for the packaging machine, which select and segregate groups of products into sets of, for example, twelve, eight, etc., it generally has been preferred to position the carton feeder for such automated systems above the product conveying line in order to give the maximum clearance or room for the selector mechanisms. In many instances, such as where multiple lanes of products are being moved through the packaging machine, the size and/or configuration of the product selector mechanisms further can prevent or restrict the positioning of the carton feeding system along the sides of the conveying lines. As a result, such carton feeding systems generally are positioned above the lanes of products moving through the packaging machine and feed the cartons into an overlying position on top of the products, as illustrated schematically in FIG. 1, to provide the maximum clearance and room for the selector mechanisms to operate.

As shown in FIG. 1, such systems typically include a rotary feeder 1 that pulls the carton 2 from a carton magazine 3 and deposits the cartons on a first, transfer conveyor 4 below the feeder. The cartons are then conveyed to an overhead lug or transport conveyor 6 that conveys the cartons into engagement with products 7 passing therebeneath. With such a system, however, the size of products that can be packaged with such an arrangement typically is limited given the required clearances between the feeder and transfer conveyor, and between the transfer conveyor and the overhead lug or transport conveyor for receiving and feeding the cartons into an overlying relationship over the products. In addition, the size and/or configuration of the products that can be used in such a system likewise generally is limited as, for example, if the products are short, the lower or transfer conveyor can interfere with the mechanisms therebelow. Further, such systems generally require several transfers or hand-offs of the cartons, thus increasing the potential for misfeeding of the cartons.

Accordingly, it can be seen that a need exists for a carton feeding system for a product-packaging machine that addresses these related and unrelated problems in the art.

SUMMARY OF THE INVENTION

The present invention generally comprises an improved carton feeding system for feeding cartons from a stack or magazine of cartons into an overlying relationship with a series or groups of products or articles passing through a product-packaging machine for packaging the articles in the cartons. The carton feeding system can be used with various types of product-packaging machines running one or multiple lanes or lines of products and typically will be mounted above the lanes of products for feeding the cartons into an overlying relationship over selected groups of the products. The carton feeding system further can be adjusted to accommodate varying sizes of cartons and product sizes and configurations, such as, for example, for forming six, eight, or twelve packs of bottles or cans.

The carton feeding system generally has an upstream, input end and a downstream or discharge end and includes a frame that rotatably supports a carton feeder in a spaced position above the product lanes. The frame generally includes a pair of structural frame plates supporting the carton feeding system in a desired orientation or angle with respect to the product lanes, and a pair of feeder support plates movably mounted on support rods attached to the structural frame plates. The feeder support plates are laterally adjustable with respect to the structural frame plates by operation of a side adjustment mechanism or system to accommodate varying size cartons. The carton feeding system also includes vertical and lateral adjustment mechanisms engaged by a manually operated or automated controls to accommodate different sizes and configurations of products and cartons, and differing numbers of lanes of products passing through the product-packaging machine.

The carton feeder typically is a rotary type carton feeder having a series of carton engaging assemblies, each including spaced vacuum cups connected to a vacuum system. The vacuum cups typically are rotated into engagement with and pick the cartons from a carton magazine or supply and thereafter move the cartons along a feed path into the product-packaging machine. A carton guide assembly is mounted to the feeder support plates, and extends substantially along the feed path of the cartons from a point approximately adjacent the pick point at which the vacuum cups engage and pick the cartons from the magazine, to a drop point at the second or downstream end of the carton feeding system. The carton guide assembly generally includes a pair of guide tracks extending along the frame of the feeder support plates. Each guide track defines a pathway or guide channel along its length, in which a guide chain or belt is received. Each chain includes a series of lugs attached thereto for engaging and urging the cartons along the carton feeder toward the drop point. The pathway formed in each of the guide tracks generally includes a first section or upstream portion spaced from the cartons and vacuum cups to maintain the lugs out of engagement with the cartons; a second, intermediate or transition section angled slightly outwardly so as to guide the lugs toward engagement with the cartons; and a third or downstream portion extending substantially parallel to the path of the cartons, along the carton feeding system for the drop point of the cartons.

The carton guide assembly further generally includes a pair of spaced chute plates, each mounted to a feeder support plate. Each of the chute plates generally includes a first or input end positioned adjacent and slightly downstream from the carton pick point to a distal end adjacent the drop point for the cartons, and provides a guide surface for supporting the outer edges of each of the cartons. The chute plates further generally include lug receiving slots or openings for receiving the lugs of the guide chain therethrough as the lugs engage and urge the cartons along a feed path toward the drop point. A central guide plate generally is positioned intermediate or between the chute plates, and a series of guide bars can be extended along the lower part of the carton feeding system approximately parallel to the feed path of the cartons for supporting and guiding the center portion of each of the cartons as the cartons are fed toward their drop point.

Various objects, features, and advantages of the present invention will become apparent to those skilled in the art upon reading the following detailed description, when taken in conjunction with the accompanying drawings.

DETAILED DESCRIPTION OF THE INVENTION

Figure 1:
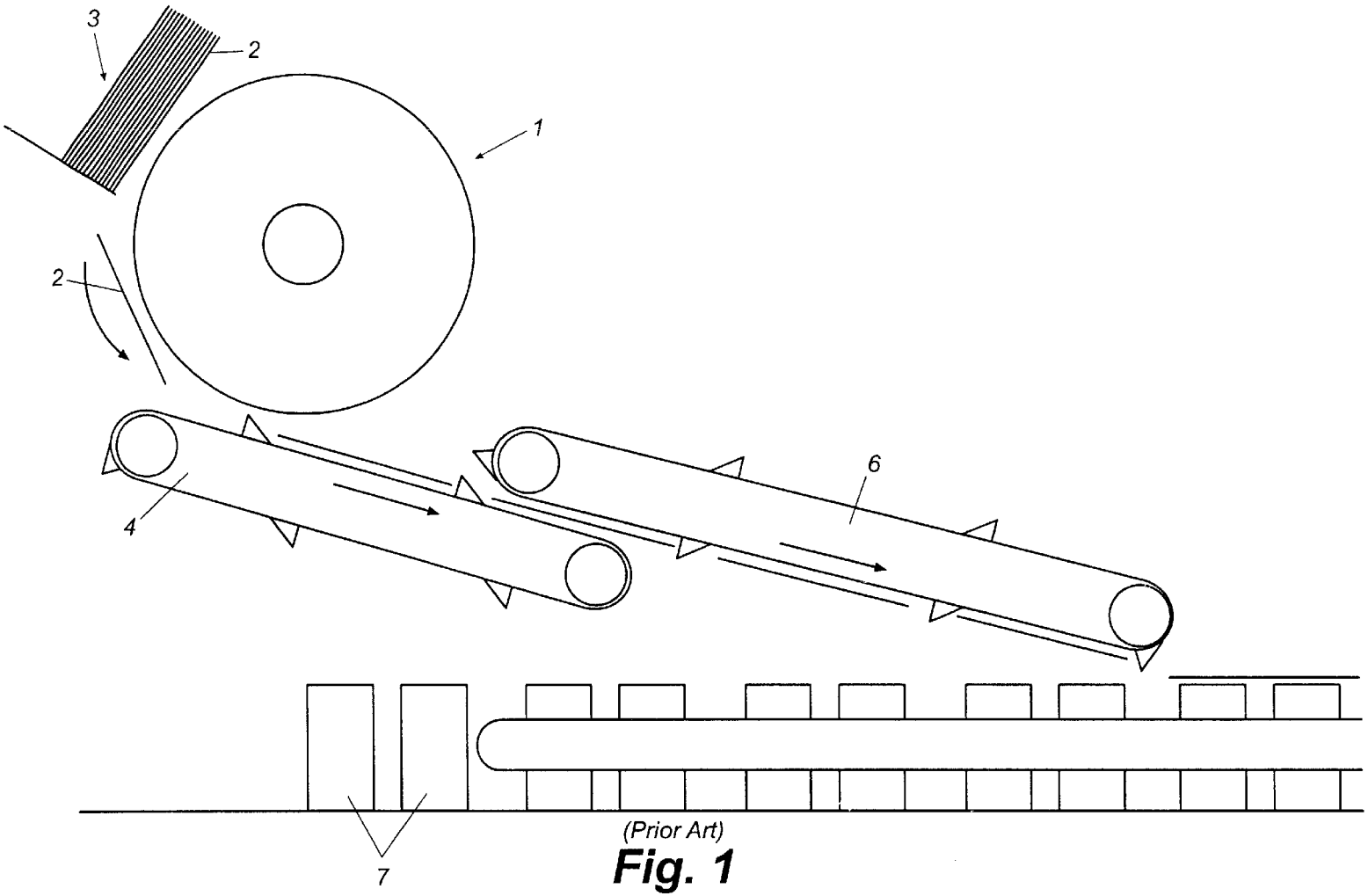
(Prior Art) Fig. 1
FIG. 1 is a side view schematically illustrating a prior art overhead carton feeding system.

Referring now in greater detail to the drawings in which like numerals indicate like parts throughout the several views, FIGS. 2–5 illustrate a carton feeding system 10 for feeding a series of cartons C into a product-packaging machine 11 for packaging a series of products P such as a series of beverage bottles (FIGS. 2 and 3) or cans (FIG. 4) being passed below the carton feeding system 10 along one or more product lanes 12. Typically, the cartons will be paperboard cartons as generally used in the packaging industry such as for packaging beverage containers such as bottles and/or cans to form "eight-packs", "twelve-packs", etc., although the present invention can be used with a variety of different sizes and types of cartons and products and should not be limited solely to feeding cartons for packaging beverage containers. The cartons further generally will range in size from approximately 7 inches to 38 inches, although it will be understood by those skilled in the art that the carton feeding system of the present invention can be adjusted or varied to accommodate and thus can be used to feed cartons of a variety of different sizes and configurations, including cartons smaller than 7 inches and cartons greater than 38 inches in length.

As shown in FIGS. 2–5, the carton feeding system 10 is typically positioned above the product lanes 12 of the product-packaging machine, generally oriented at a desired angle with respect to the products P passing therebeneath so as to feed a series of cartons C individually along a feed path 13 into an overlying relationship over a selected group or set of products. The carton feeding system 10 generally includes an upstream or first end 16 from which the cartons C are fed, and a downstream or second end 17 above the lanes of products P, defining a drop point 18 at which the cartons are released or dropped from the carton feeding system onto or over the products passing therebeneath. The carton feeding system 10 further includes a feeder frame 20 that supports a carton feeder 21 and which is generally mounted to and/or supported over the packaging machine 11.

As indicated in FIGS. 2–5, the feeder frame 20 generally includes a pair of spaced, outer, structural frame plates 22 on which the carton feeder 21 is rotatably supported, each of which is generally formed from a rigid, high strength materials such as a metal such as steel or aluminum, or other materials such as various types of composite materials. Each of the frame plates 22 has an inner side surface 23 and an outer side surface 24, with the frame plates generally being mounted to and supported from adjustable supports 26 (FIG. 3) generally mounted on the packaging machine.

Figure 3:
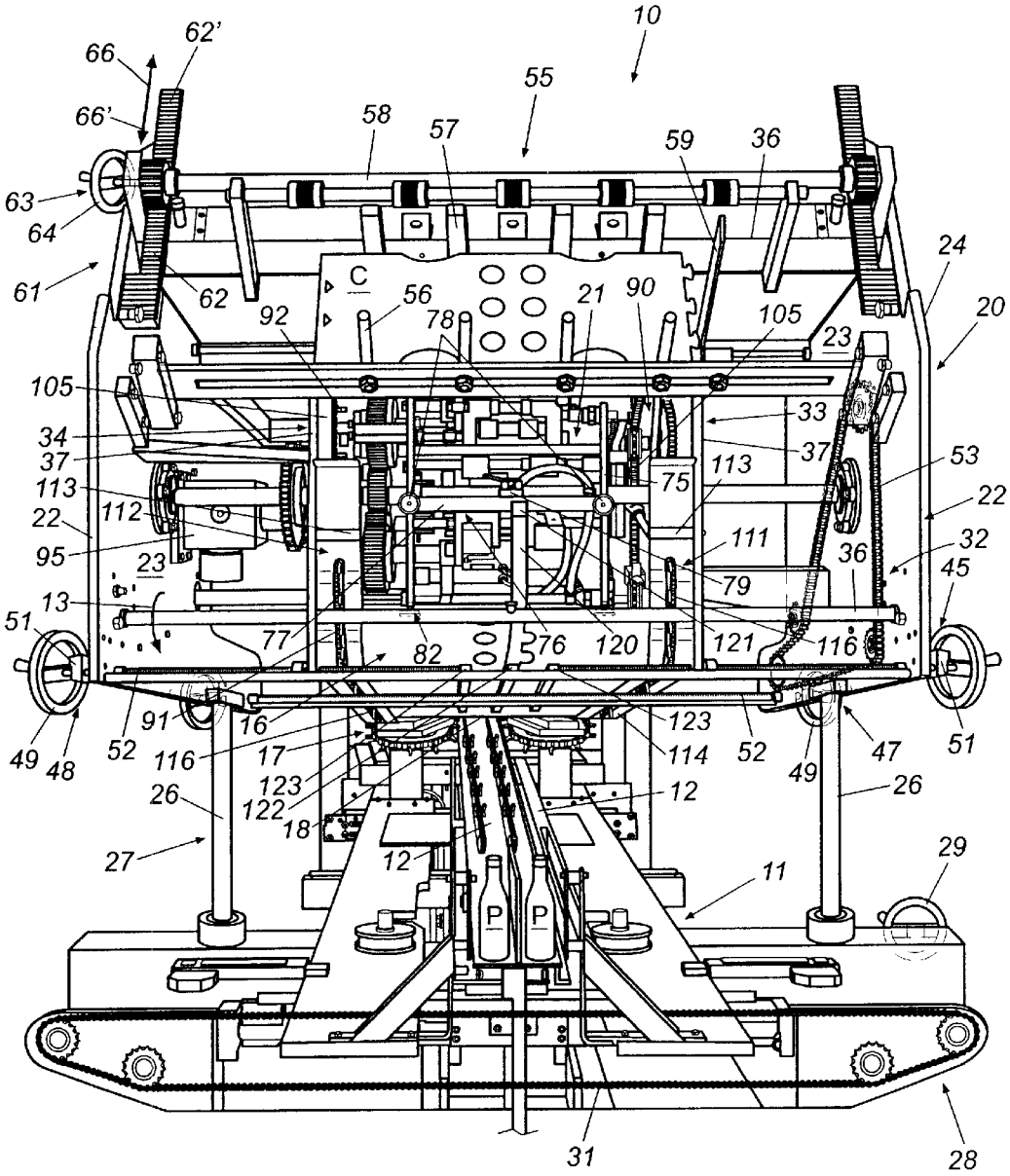
FIG. 3 is an end view of the carton feeding system of FIG. 2.

A vertical adjustment mechanism or system 27 generally is connected to the supports 26 in a driving relationship to enable adjustment of the vertical position of the carton feeding system 10 above the product lanes 12, as needed, depending upon the size and configuration of the products and the cartons C being fed into the product-packaging machine as indicated in FIG. 3. Typically, the vertical adjustment system will include an actuator or drive mechanism 28 such as a manually operated hand-wheel or crank, such as indicated at 29 (FIG. 3), or a similar manually operated or motorized drive (not shown) is connected to supports 26 in a driving relationship by a chain 31 and typically further can include an indicator or position sensor, or can be linked to the control system for the packaging machine, for controlling the height adjustment.

As further generally illustrated in FIG. 3, a series of angle alignment or adjustment setting holes 32 typically will be formed in each of the structural frame plates to enable easy setting of the orientation or cant of the carton feeding system at varying desired angles with respect to the products flowing in the product lanes therebelow. For example, pre-drilled pairs of holes 32 for 5°, 7.5°, 10° and 15° angle orientations, and/or other angles, can be formed in the outside structural plates for ease of positioning the carton feeding system of the present invention at a desired angle orientation as needed for feeding the cartons onto the selected grouping of products.

The feeder frame 20 further includes a pair of spaced feeder support plates 33 and 34 positioned between the structural frame plates 22 and moveably supported on a series of transverse support beams or rods 36. Each of the feeder support plates 33 and 34 generally is formed from a rigid, high strength material such as a metal such as steel or aluminum, or can be formed from various types of composite materials. Each feeder support plate has a substantially "L" shaped configuration with a rear or main body portion 37; a narrowed, elongated front or discharge portion 38; and inwardly facing and outwardly facing side surfaces 39 and 41.

Figure 2:
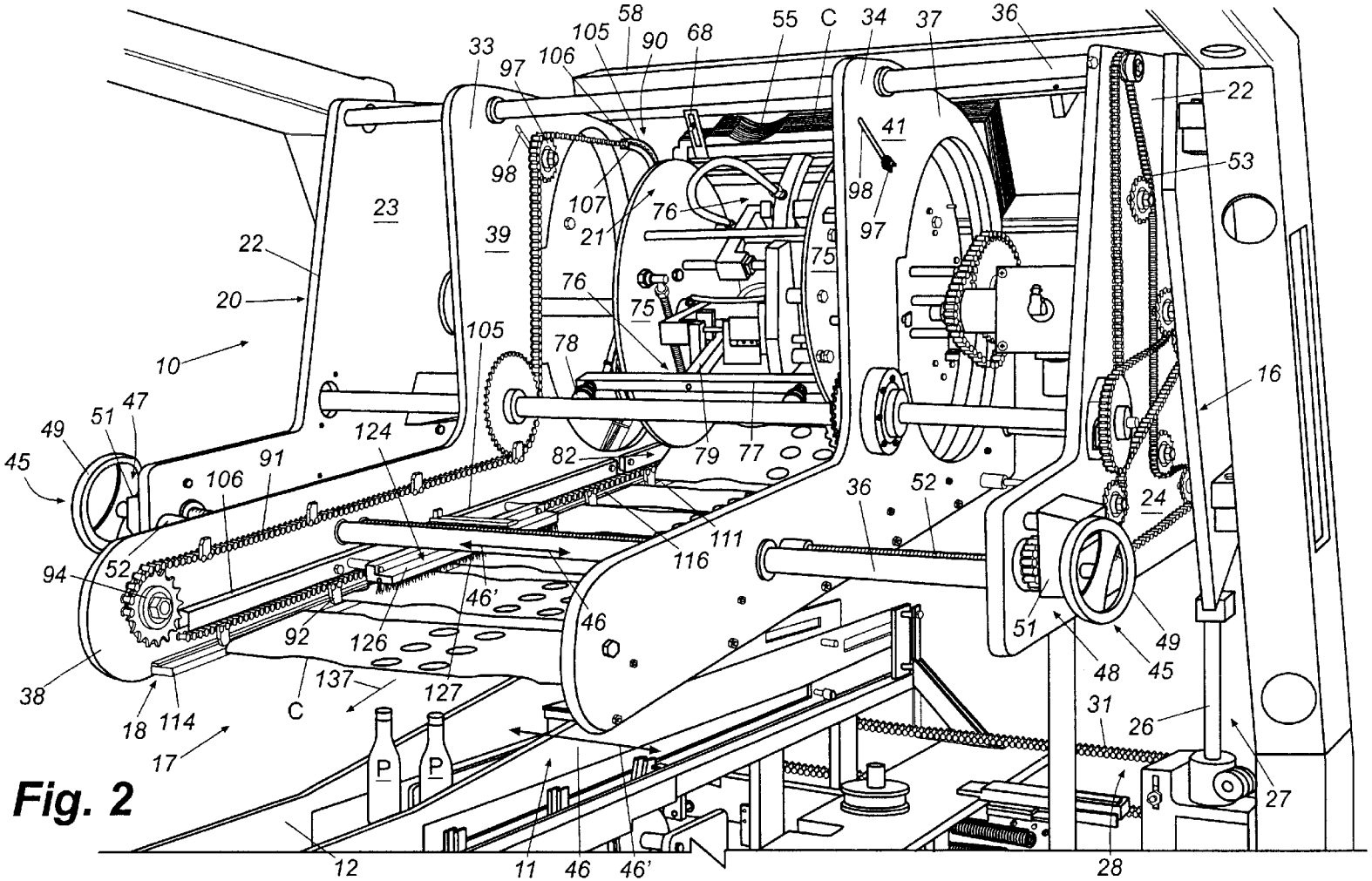
FIG. 2 is a perspective illustration of the carton feeding system of the present invention positioned above a series of spaced lanes of products passing through a product-packaging machine.

A side adjustment mechanism or system 45 is provided for moving the feeder support plates 33 and 34 laterally back and forth across the width of the packaging machine, with respect to the product lanes 12 (FIG. 2) passing therebeneath in the direction of arrows 46 and 46'. The side adjustment mechanism 45 generally includes a pair of adjustment assemblies 47 and 48 mounted to the frame plates for moving or adjusting the lateral position of the feeder support plates. Each adjustment assembly generally includes a manually operated drive or actuator 49, such as a hand-wheel, and an indicator 51 mounted along an outside surface 24 of its associated structural frame plate 22, as indicated in FIG. 2. Each of the hand wheels generally is connected to a rack or travel screw 52 that is in turn connected to or engages its respective feeder support plate 33 or 34, such that as each hand wheel is rotated, its feeder support plate 33 or 34 is independently moved laterally in the direction of arrows 46 and 46'. The feeder support plates 33 and 34 are thus caused to move along their support rods 36 to adjust the lateral position of the feeder support plates with respect to the lanes or products passing therebeneath to adjust the configuration of the carton feeding system 10 to accommodate varying lengths and configuration of cartons C and various lanes, sizes and/or configurations of products P passing therebeneath.

The position of each feeder support plate is indicated by a numerical reference or read-out provided by its associated indicator 51, which generally provides a numerical reference as to the position of its respective feeder support plate along the support rods or rack. This reference further does not necessarily have to be measured in units such as inches or centimeters, but generally provides a reference that coincides with the position or spacing of each of the feeder support plates with respect to one another or with respect to their associated structural frame plates. It will also be understood that more sophisticated positioning sensors or measuring devices also can be used. In addition, it will be understood that automated drive systems can be used in place of the hand wheels or other manual actuators for controlling the movement of the feeder support plates with respect to the lanes of products passing therebeneath as needed, depending upon the particular packaging operation or application. As indicated in FIG. 2, a drive chain or belt 53 generally is extended about the outer end of the rack or travel screw 52 for each of the side adjustment assemblies 47 and 48, and extends in a substantially serpentine path about a series of additional guides or travel screws (not shown) positioned adjacent each of the support rods 36, such that as the hand wheel of each side adjustment assembly is operated, its associated feeder support plate is uniformly moved along support rods 36 inwardly and outwardly to the desired lateral position.

Figure 4:
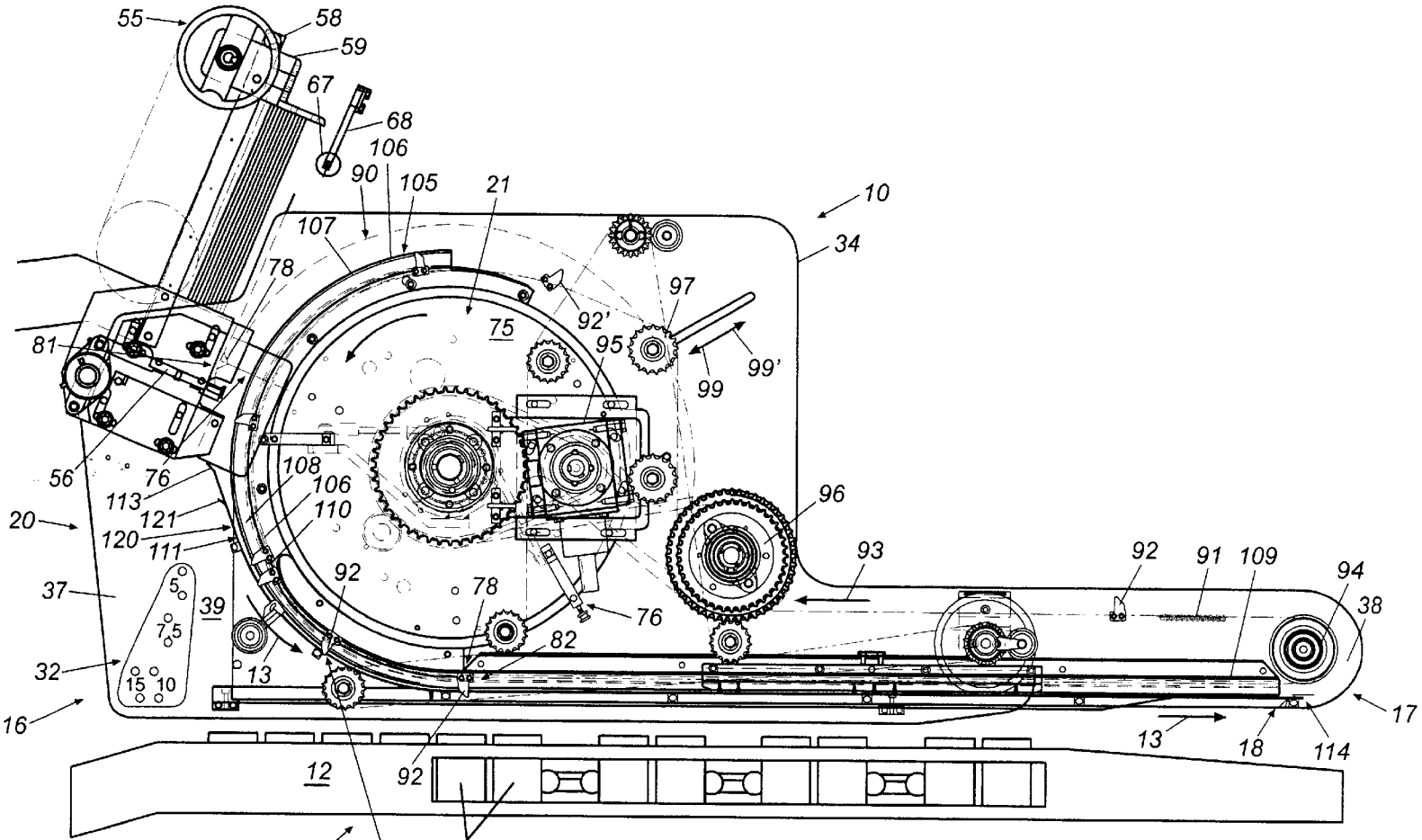
FIG. 4 is a side view, taken in cross section, of the carton feeding system of FIG. 2.

As shown in FIGS. 2–4, a magazine 55 is positioned above the upstream end 16 of the carton feeding system 10. The magazine 55 generally is formed as a hopper or cage having a lower support or guides, such as support spaced rods or bars 56 generally mounted on or supported by the feeder frame 20; a series of upper guides such as plates or bars 57 mounted on an upper support beam or frame member 58, and at least one laterally adjustable side plate 59 defining a hopper or receiving zone or area in which a stack of cartons C is received as shown in FIG. 3. A magazine adjustment mechanism or assembly 61 generally is connected to the upper support beam 58 for adjusting the height of the magazine to accommodate differing width cartons, while the adjustable side plate 59 enables variations in the length and/or positioning of the cartons above the feeder 21 as needed depending upon the configuration of the cartons. The magazine adjustment mechanism 61 includes a rack or travel screw 62 mounted to the upper support beam 58 and engaged by a drive 63, such as a hand wheel or crank 64, although other types of manual or automated drive mechanisms or actuators also can be used. As the hand wheel 64 is rotated, it causes shaft and pinion gears to rotate, driving the upper guides upwardly or downwardly in the direction of arrows 66 and 66' toward and away from the lower supports 56 to accordingly adjust the height or size of the magazine as needed depending upon the size of cartons being loaded therein.

As shown in FIG. 4, a feed roller 67 is generally positioned in front of the magazine, mounted to an arm or similar support 68 that is biased toward the stack of cartons loaded in the magazine so as to provide a movable bearing surface against which the stack of cartons is placed. The feed roller holds the stack of cartons in a desired orientation, while enabling engagement and removal of the cartons on an individual basis from the magazine by the carton feeder, as illustrated in FIG. 4.

Figure 5:
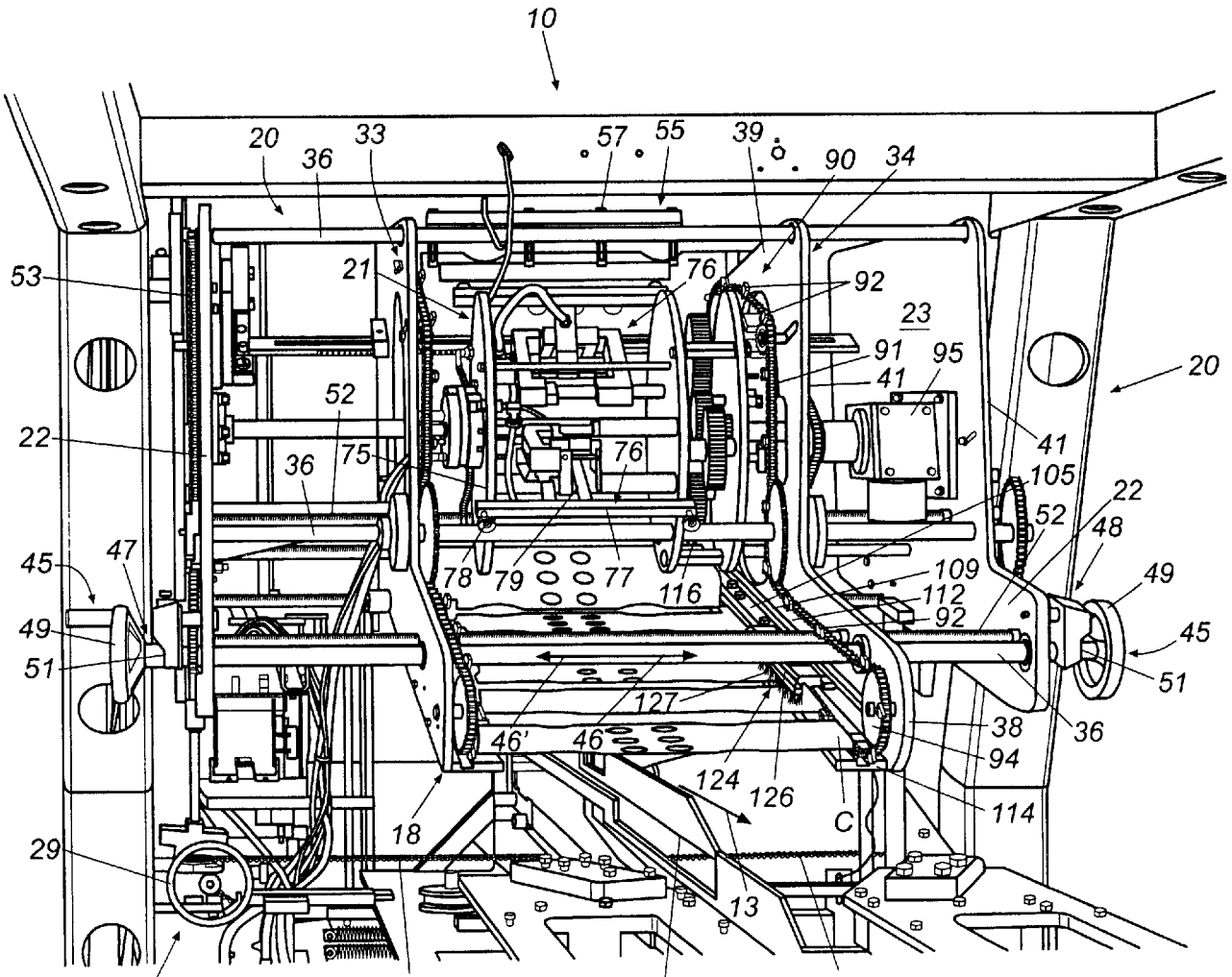
FIG. 5 is a perspective view of the carton feeding system of the present invention, showing the side adjustment mechanism of the carton feeding system.

As generally indicated in FIGS. 2, 3 and 5, the carton feeder 21 generally is a rotary type carton feeder such as disclosed in U.S. Pat. No. 5,234,314 of Ganz, the disclosure of which is hereby incorporated by reference. It will, however, be understood by those skilled in the art that other types of carton feeding systems also can be used. For example, the carton feeder can be a MARKSMAN model 2100 3–4 head type carton feeder as manufactured by Riverwood International Corporation. The carton feeder 21 typically has an internal drum or wheels 75 carrying a series of carton engaging assemblies 76 in a circular or rotary motion. Each carton engaging assembly includes a vacuum head 77 (FIG. 3) having a pair of spaced vacuum cups 78 and which is mounted to a support arm 79 connected to a vacuum system or plenum (not shown). Preferably, the vacuum heads are formed as quick change-out heads that can be easily connected to and/or disconnected from the support arms 79 to enable substitution of varying sized vacuum heads having varied spacings between the vacuum cups thereof as needed, depending upon the size cartons being engaged and fed through the carton feeding system.

As indicated in FIG. 4, the carton engaging assemblies 76 are rotated through a pick point 81 (FIG. 4) adjacent the lower end or edge of the magazine 55, where the vacuum cups 78 will engage and pick a carton from the stack of cartons C within the magazine. As the rotation of the carton engaging assemblies 76 continues, each carton engaged thereby is pulled downwardly and reoriented into a substantially horizontally extending attitude for feeding along the carton feed path 13. As the carton engaging assemblies are further rotated around and begin their upward travel away from the carton path 13, as indicated in FIG. 4, the vacuum or suction being applied through the vacuum cups against the surface of each carton is deactivated at a release point, indicated by arrow 82 in FIG. 4, to release the cartons and free the carton engaging assemblies for engagement with additional ones of the cartons as the carton engaging assemblies are rotated back around toward the magazine 55.

As illustrated in FIGS. 2–4, the carton feeding system 10 further includes a guide assembly 90 having a pair of carton guide chains or belts 91, each with a series of spaced carton lugs 92 mounted thereto. The guide chains are driven in a substantially elliptical drive path 93, although the paths of the chains can be varied as needed to accommodate various carton feeders and/or size carton engaging assemblies, for engaging and urging the cartons approximately from the release point of the vacuum assemblies of the carton feeder to the drop point 18 adjacent the downstream end of the carton feeding system. As indicated in FIGS. 2 and 4, the guide chains 91 are each positioned on an inwardly facing surface 39 of a feeder support plate 33 or 34 and extend about an idler sprocket or gear 94 and about a drive sprocket or gear 96. The drive chains can be driven by a motor 95 (FIG. 4) or by the drive system for the carton feeder so as to rotated in timed relation with the rotation of the vacuum assemblies of the carton feeder.

As shown in FIG. 4, each guide chain or belt further is generally extended about a take up sprocket or gear 97 that is movably mountable along a positioning or take up slot 98 formed in the feeder chute plate on which the guide chain is mounted. Each take up sprocket 97 is movable in the direction of arrows 99 and 99' along its slot 98, so as to adjust the chain path 93 as needed for varying the pitch of the chain. Each of the lugs 92 generally is attached at spaced locations along the length of each guide chain, typically corresponding to the width and/or a desired spacing between each of the cartons being fed through the carton feeding system of the present invention. Each lug is a substantially rigid member, typically formed from plastic or a similar material, having a front edge or pusher surface 101 (FIGS. 2 and 4) adapted to engage and urge the cartons along the feed path 13.

As indicated in FIGS. 2–5, a guide track 105 is mounted to the inwardly facing surfaces 39 of each of the feeder support plates 33 and 34. Each of the guide tracks generally is formed from a rigid, reduced friction material and defines a guide channel or pathway 106 along which the guide chains 91 are received and guided for controlling movement of the lugs 92 attached to the guide chains into and out of engagement with the cartons. The guide channels 106 of guide tracks 105 include a first, initial section or portion 107 extending from a point above and in front of the pick point 81 at which the vacuum assemblies engage and pick the cartons from the magazine 55 (FIG. 4); a second, intermediate or transition section 108 that extends from a point adjacent and downstream from the pick point 81 toward the carton release point 82 where the vacuum assemblies release their attached cartons; and a third or discharge section 109 that extends substantially along the length of the front portion 38 of each feeder support plate to the drop point 18 for guiding the forward movement of the lugs and thus the cartons being urged thereby along the carton feed path 13.

The guide tracks control the movement of the drive chain and lugs and initially maintain the lugs out of engagement with the cartons as the cartons are engaged and picked from the magazine by the carton engaging assemblies of the carton feeder to avoid interference with the engagement and picking of the cartons by the carton feeder. Once a carton has been picked, as indicated in FIG. 4, the intermediate section 108 of each guide track 105 includes an outwardly curving section 110 that extends away from the central axis of the feeder and toward the cartons, so as to guide the lugs outwardly and toward engagement with the cartons. Thereafter, the guide tracks control the outward movement and catching up of the carton lugs into engagement with the cartons as the cartons are released from the carton engaging assemblies and thereafter continue to be conveyed along their feed path toward the drop point.

As also indicated in FIG. 4, the lugs attached to the guide chains can be articulated lugs, as indicated by 92' in FIG. 4, that are pivotally attached to their guide chains. This enables the lugs to pivoted toward or away from engagement with the cartons, such as by engagement of the lug with a cam surface (not shown) along its respective guide track, so as to cause the lugs to be pivoted to a position adapted to engage the cartons. Thereafter, as the guide chains continue back toward the carton feeder after release of the cartons, the lugs can engage a downstream or further can surface to cause them to be pivoted back to a rest or non-engaging portion as they approach the magazine.

Additionally, the guide assembly 90 further includes spaced chute plates 111 and 112 (FIG. 3) each mounted to one of the spaced feeder support plates, projecting inwardly therefrom. Each of the chute plates generally is formed from a metal such as steel or similar material having smooth or reduced friction upper surfaces, along which the outer side edges of the cartons are received and supported as the cartons are conveyed to the drop point. Each of the chute plates generally includes a beveled or angled input or first end 113 (FIGS. 3 and 4), a distal or second end 114 (FIGS. 2 and 4) adjacent the drop point 18 for the cartons, and each further generally includes a lug receiving slot 116 extending from an intermediate point downstream from the first end 113 to the second end 114 of each chute plate. The lugs 92 of the guide chains 91 are received and project through the lug receiving slots 116 of the chute plates 111 and 112 to enable the guide lugs to move along the chute plates as they urge the cartons along the carton feed path 13 toward the drop point.

In addition, as shown in FIGS. 2 and 3, a central guide 120 is generally mounted between the chute plates 111 and 112, typically mounted on or supported from one of the support rods 36 of the feeder frame 20. The central guide 120 generally is a metal strip or plate, although other types of materials can be used, having a polished or smooth upper surface so as to provide a reduced friction surface for supporting a central portion of the cartons as they are fed along the carton feed path 13. As indicated in FIG. 2, the central guide 120 also generally includes a beveled or angled front or input end 121 for facilitating receipt of the leading edge of the cartons thereon and a second or distal end 122 (FIG. 2).

As shown in FIGS. 2 and 3, a series of guide bars 123 are provided below the central guide 120, positioned between the chute plates 111 and 112. The guide bars generally extend substantially longitudinally along the length of the carton feeding system, extending approximately parallel to the feed path of the cartons and support the central portion of the cartons as the cartons are urged along their carton feed path, as indicated in FIG. 2. The number and spacing of the guide bars generally can be varied depending upon the type and size of cartons fed, products being packaged, as well as the number of lanes of products being conveyed thereunder to minimize potential interference with the products by the guide bars.

A series of control brushes 124 (FIGS. 2, 4 and 5) further typically are mounted along the forwardly extending front portion 38 of each of the feeder support plates 33 and 34, mounted to projecting inwardly from the inwardly facing side surfaces 39 thereof. The control brushes 124 each generally include a base 126 having a series of downwardly extending bristles 127 that engage and bear against the surfaces of the cartons as the cartons are being conveyed thereunder, so as to urge and maintain the cartons against the front bearing surfaces 101 of the lugs 92.

In operation of the carton feeding system 10 of the present invention as illustrated in FIGS. 2, 4 and 5, a carton C within the magazine of cartons 55 is engaged and picked from the stack of cartons by the engagement of vacuum cups 78 of one of a series of carton engaging assemblies 76 of the rotating carton feeder 21. As each carton is picked from the magazine 55, it is conveyed downwardly under the control of its carton engaging assembly, with the ends and middle or central portions of the cartons being received and supported on the spaced chute plates 111 and 112, and central guide 120, respectively.

As indicated in FIG. 4, as each vacuum assembly moves its selected or picked carton along the feed path and into a horizontal attitude, a carton lug 92 of each of the guide chains 91 generally is moved into a position extending through the lug receiving slots of each of the chute plates 111 and 112 as the guide chains to which the lugs are mounted are passed along the intermediate section 108 of each guide track channel 106. As a result, the lugs are moved outwardly from a retracted position out of engagement with the cartons to an extended or engaging position for engaging and urging the cartons forwardly along their feed path 13. Thereafter, each of the carton lugs is moved forwardly into engagement with the selected carton C (FIG. 2), and begins to urge the carton forwardly as the vacuum applied to the carton by each of the carton engaging assemblies 76 is discontinued and the carton is released from its carton engaging assembly at the release point 82 (FIG. 4).

The carton lugs continue to urge the cartons forwardly as the drive chains are moved about their drive path, while at the same time the disengaged carton engaging assemblies are rotated back around to a position for engaging and picking an additional carton from the stack of cartons contained within the magazine 55. Typically, as the cartons are urged along their feed path 13 toward the drop point 18 by the forward movement of the lugs 92, the products P passing therebeneath are engaged and separated into groups of products by carton selector mechanisms for the packaging machine. For example, a series of bottles could be separated or segregated into four, six, or eight pack configurations or groups, which are fed below the drop point of the carton feeding system as each of the cartons reaches the drop point. As indicated in FIGS. 2 and 4, as the segregated or separated groups or sets of products reach the drop point for the cartons, the cartons are deposited or overlaid over the groups of products for wrapping packaging about the groups of products as they proceed through the product-packaging machine.

The present system eliminates at least one conveyer, such as that designated as (4), and provides a mechanism that has the transfer lugs (92) and guide chain (91) running on the same side of the carton as the vacuum cups (78) of the carton feeder (21). This eliminates at least one "handoff" of the carton leading to a more positive transfer and conveyance of the carton to the product group. This allows both higher speeds and reduction in misplacement of cartons. Thus, the surface of the carton C that is picked by the vacuum cups (78) always faces toward the guide chain (91) during the entire travel path. It should be understood that while the present system is the best known to date, it is possible to construct a functionally similar system in which the guide chain (91) does not wrap completely around the carton feeder (21), as shown, but rather forms a loop in the area of the vacuum cup pick up by the carton feeder (21). The function remains the same in that the carton is still transported by transfer lugs (92) running on the same side of the carton as that which was picked by the vacuum cups (78).

It will be understood by those skilled in the art that while the present invention has been disclosed with reference to a preferred embodiment or embodiments, the present invention should not be limited solely to the disclosed embodiments, but rather is and should be entitled to a full range of equivalents as would be understood by those skilled in the art. It will be further understood that various additions, changes and modifications can be made to the present invention without departing from the spirit and scope of this invention as set forth in the following claims.

What is claimed is:

1. A system for feeding cartons from a magazine of cartons into a packaging machine for packaging products passing through the packaging machine, comprising:

a feeder frame;

a carton feeder mounted within said frame and adapted to engage and pick each carton from the magazine of cartons; and a carton guide assembly adjacent said carton feeder and including at least one guide chain or belt having a series of spaced lugs mounted thereto for engaging and urging the cartons away from said carton feeder and toward a drop point for application to a selected group of the products passing through the packaging machine, and at least one guide track mounted to said feeder frame adjacent said carton feeder and defining a pathway along which said guide chain or belt is received and passes for guiding said lugs out of and into engagement with each carton engaged by said carton feeder and for guiding said guide chain or belt and said lugs along said feed path to urge each carton toward said drop point.

2. The system of claim 1 and wherein said carton guide assembly further comprises at least one chute plate extending from a first end positioned adjacent a pick point where said carton feeder engages and picks a carton from the magazine of cartons to a second end adjacent said drop point for supporting each carton as each carton is moved from the magazine to said drop point.

3. The system of claim 2 and wherein said at least one chute plate comprises a pair of spaced chute plates each having a lug receiving slot formed therein.

4. The system of claim 2 and wherein said at least one chute plate comprises a pair of spaced chute plates supporting each end of the cartons passing therealong and a central guide positioned between said chute plates.

5. The system of claim 4 wherein each of said chute plates includes a lug receiving slot, along which said lugs are received and passed as the cartons are moved toward said drop point.

6. The system of claim 1 and wherein said at least one guide track comprises a pair of spaced guide tracks mounted adjacent said carton feeder and wherein said pathway defined in each guide track includes an upstream portion spaced from the cartons to maintain said lugs out of engagement therewith, a transition portion for guiding said lugs toward the cartons, and a downstream portion for guiding said lugs in engagement with the cartons toward said drop point.

7. The system of claim 1 and wherein said feeder frame includes a pair of frame plates, a series of support rods, and spaced feeder support plates moveably mounted on said support rods and supporting a pair of spaced chute plates of said carton guide assembly.

8. The system of claim 7 and further comprising a side adjustment system including at least one adjustment assembly for moving said feeder support plates laterally with respect to said carton feeder to accommodate varying size cartons.

9. The system of claim 8 and wherein said at least one adjustment assembly comprises an actuator and an indicator for indicating position of each feeder support plate.

10. The system of claim 9 and wherein said actuator of said at least one adjustment assembly comprises a manually operated hand-wheel.

11. The system of claim 1 and wherein said lugs include articulated lugs that are pivotable into and away from engagement with the cartons.

12. The system of claim 1 and further comprising a take-up sprocket movable along an adjustment slot for adjusting a pitch of said at least one guide chain.

13. The system of claim 1 and wherein said carton feeder and carton guide assembly cooperate to define a path of travel of a carton such that the surface of the said carton that is engaged and picked by the carton feeder always faces toward said guide chain.

14. A carton feeding system for feeding cartons into a product packaging machine for packaging a series of products passing through the product packaging machine, the carton feeding system comprising:

a frame adjustably mounted on the packaging machine and including a pair of feeder support plates moveable laterally with respect to the products passing through the product packaging machine;

a carton feeder mounted between said feeder support plates and including at least one carton engaging assembly adapted to engage and move a carton along a carton feed path; and a guide assembly including at least one guide track mounted to at least one of said feeder support plates and defining a pathway therealong, a guide chain received within said pathway and including a series of carton lugs mounted thereto for engaging and urging the cartons along the feed path, and at least one chute plate for supporting the cartons as the cartons are moved along the feed path toward the products passing through the product packaging machine.

15. The carton feeding system of claim 14 and further comprising a side adjustment system including at least one adjustment assembly for moving said feeder support plates laterally with respect to said carton feeder to accommodate varying size cartons.

16. The carton feeding system of claim 15 and wherein said at least one adjustment assembly comprises an actuator for moving one of said feeder support plates and an indicator for indicating a position of said one of said feeder support plates.

17. The carton feeding system of claim 14 and wherein said at least one chute plate comprises a pair of chute plates each mounted to one of said feeder support plates so as to be moveable therewith, and each including a lug receiving slot formed therealong.

18. The carton feeding system of claim 14 and wherein said at least one guide track comprises a pair of spaced guide tracks mounted along said feeder support plates adjacent said carton feeder and wherein said pathway defined in each guide track includes an upstream portion spaced from the cartons to maintain said lugs out of engagement therewith, a transition portion for guiding said lugs toward the cartons, and a downstream portion for guiding said lugs in engagement with the cartons toward said drop point.

19. The carton feeding system of claim 14 and further comprising a magazine for receiving a stack of cartons mounted at an upstream end of the carton feeding system in a position wherein the cartons are engaged by said at least one carton engaging assembly of said carton feeder.

20. The carton feeding system of claim 19 and wherein said magazine comprises upper and lower supports, a height adjustment system for adjusting spacing between said upper and lower supports, and at least one side plate.

21. The carton feeding system of claim 14 and further comprising a height adjustment mechanism for adjusting a vertical position of said carton feeder with respect to products passing therebeneath.

22. The carton feeding system of claim 14 and wherein said carton feeder and said guide assembly cooperate to define a path of travel of a carton such that the surface of said carton that is engaged by said carton feeder always faces toward said guide chain.

23. A method of feeding cartons into a product packaging machine for packaging a series of products passing through the packaging machine, comprising:

engaging and moving a carton along a carton feed path with a carton engaging assembly;

moving a lug of at least one guide chain from a position spaced from the carton into a position adapted to engage the carton as the carton is moved along the feed path;

releasing the carton from the carton engaging assembly;

as the carton is released from the carton engaging assembly, engaging the carton with the lug and urging the carton along the feed path toward a drop point; and depositing the carton into an overlying relationship on a series of products passing adjacent the drop point for the carton.

24. The method of claim 23 and wherein moving a lug of at least one guide chain from a position spaced from the carton comprises moving the guide chain along a transition section of a chain guide track, whereby the lug is caused to move toward the carton.

25. The method of claim 23 and further comprising supporting and moving an opposite end of the carton on a chute plate as the cartons are moved toward the drop point.

26. The method of claim 25 and wherein moving a lug of at least one guide chain comprises directing the guide chain along a transition section of a guide track along which the guide chain is received so as to guide the lug to a position extending through a lug receiving slot formed in at least one of the chute plates along which the carton is moved.

27. The method of claim 23 further comprising maintaining the surface of said carton which was engaged and moved by said carton engaging assembly facing toward said guide chain during the entire time said carton is moved by said lug.

* * * * *